US009849577B2

(12) United States Patent
Wyler et al.

(10) Patent No.: US 9,849,577 B2
(45) Date of Patent: Dec. 26, 2017

(54) ROTARY HAMMER

(71) Applicant: Milwaukee Electric Tool Corporation, Brookfield, WI (US)

(72) Inventors: Andrew R. Wyler, Pewaukee, WI (US); Jeremy R. Ebner, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 649 days.

(21) Appl. No.: 14/325,733

(22) Filed: Jul. 8, 2014

(65) Prior Publication Data

US 2014/0318821 A1 Oct. 30, 2014

Related U.S. Application Data

(63) Continuation-in-part of application No. 13/757,090, filed on Feb. 1, 2013, now Pat. No. 9,308,636.
(Continued)

(51) Int. Cl.

| | |
|---|---|
| ***B25F 5/02*** | (2006.01) |
| ***B25F 5/00*** | (2006.01) |
| ***B25D 17/24*** | (2006.01) |
| ***B25D 11/12*** | (2006.01) |
| ***B25D 17/04*** | (2006.01) |
| ***B25D 11/00*** | (2006.01) |

(52) U.S. Cl.
CPC ..... *B25F 5/006* (2013.01); *B25D 11/005* (2013.01); *B25D 11/125* (2013.01); *B25D 17/043* (2013.01); *B25D 17/24* (2013.01); *B25D 2217/0092* (2013.01); *B25D 2250/035* (2013.01); *B25D 2250/131* (2013.01); *B25F 5/02* (2013.01)

(58) Field of Classification Search
CPC ..... B25D 11/00; B25D 17/04; B25D 17/043; B25D 17/24; B25D 2217/0092; B25F 5/02; B25F 5/006; B25F 5/008
USPC ... 173/48, 104, 109, 217, 162.1, 162.2, 201, 173/170, 210; 310/47, 50
See application file for complete search history.

(56) References Cited

U.S. PATENT DOCUMENTS

| | | | |
|---|---|---|---|
| 1,358,486 | A | 11/1920 | Wilhelm |
| 3,664,021 | A | 5/1972 | Sawyer |

(Continued)

FOREIGN PATENT DOCUMENTS

| | | |
|---|---|---|
| EP | 1529603 | 5/2005 |
| EP | 1674212 | 6/2006 |
| EP | 2551061 | 1/2013 |

OTHER PUBLICATIONS

International Search Report and Written Opinion for Application No. PCT/US2014/045704 dated Oct. 28, 2014 (15 pages).

*Primary Examiner* — Scott A. Smith
(74) *Attorney, Agent, or Firm* — Michael Best & Friedrich LLP

(57) ABSTRACT

A rotary power tool includes a housing, a spindle defining a working axis, and a motor supported by the housing. The motor is operable to drive the spindle. The rotary power tool also includes a handle movably coupled to the housing and a vibration isolating assembly disposed between the housing and the handle. The vibration isolating assembly attenuates vibration transmitted from the housing to the handle. A battery pack is removably coupled directly to the handle and configured to provide power to the motor.

13 Claims, 6 Drawing Sheets

Related U.S. Application Data

(60) Provisional application No. 61/846,303, filed on Jul. 15, 2013, provisional application No. 61/737,318, filed on Dec. 14, 2012, provisional application No. 61/737,304, filed on Dec. 14, 2012, provisional application No. 61/594,675, filed on Feb. 3, 2012.

(56) References Cited

U.S. PATENT DOCUMENTS 3,837,758 A 9/1974 Streicher
3,974,885 A 8/1976 Sudnishnikov et al.
4,098,351 A 7/1978 Alessio
4,447,749 A 5/1984 Reeb, Jr. et al.
4,450,921 A 5/1984 Arvidsson et al.
4,478,293 A 10/1984 Weilenmann et al.
4,711,308 A * 12/1987 Blaas ..... B25D 17/043 16/431
4,825,548 A 5/1989 Driggers
5,025,870 A 6/1991 Gantner
5,027,910 A 7/1991 Honsa et al.
5,031,323 A 7/1991 Honsa et al.
5,054,562 A 10/1991 Honsa et al.
5,375,666 A 12/1994 Pettet et al.
5,522,466 A * 6/1996 Harada ..... B25F 5/006 173/162.2
5,588,903 A 12/1996 Pennison
5,697,456 A 12/1997 Radle et al.
5,706,902 A 1/1998 Eisenhardt
5,881,823 A * 3/1999 Kabatnik ..... B25D 17/00 173/217
5,947,211 A 9/1999 Jakobsson
6,065,905 A 5/2000 Kinton
6,076,616 A 6/2000 Kramp et al.
6,220,367 B1 4/2001 Masterson et al.
6,223,835 B1 * 5/2001 Habedank ..... B25F 5/02 173/217
6,376,942 B1 * 4/2002 Burger ..... B25F 5/02 310/47
6,382,888 B2 5/2002 Cook
6,653,815 B2 * 11/2003 Watson ..... B25F 5/02 320/114
6,675,912 B2 * 1/2004 Carrier ..... B25F 5/02 173/217
6,729,415 B1 * 5/2004 Huang ..... B25F 5/02 173/170
6,912,790 B2 7/2005 James et al.
7,039,986 B2 5/2006 Glenn et al.
7,076,838 B2 7/2006 Meixner
7,100,706 B2 9/2006 Meixner et al.
7,121,360 B2 10/2006 Funfer
7,182,150 B2 * 2/2007 Grossman ..... B23Q 1/0009 173/171
7,201,643 B2 4/2007 Dineen et al.
7,204,744 B2 4/2007 Lamprecht et al.
7,217,178 B2 5/2007 Oki et al.
7,252,156 B2 8/2007 Sugiyama et al.
7,287,601 B2 10/2007 Hellbach et al.
7,322,428 B2 * 1/2008 Bacila ..... B25D 17/043 16/431
7,363,685 B2 4/2008 Walker et al.
7,472,760 B2 1/2009 Stirm et al.
7,492,125 B2 2/2009 Serdynski et al.
7,523,790 B2 4/2009 Arakawa et al.
7,610,968 B1 11/2009 Honsa
7,624,815 B2 12/2009 Friedrich et al.
7,721,818 B2 5/2010 Inagawa et al.
7,730,589 B2 6/2010 Dineen
7,762,348 B2 7/2010 Stirm et al.
7,766,096 B2 8/2010 Satou et al.
7,789,168 B2 9/2010 Becht et al.
7,828,185 B2 11/2010 Hofmann et al.
7,836,971 B2 11/2010 Kikuchi et al.
7,866,411 B2 1/2011 Rondahl
7,878,264 B2 2/2011 Koch et al.
7,886,838 B2 2/2011 Hahn
7,886,839 B2 2/2011 Frauhammer et al.
7,921,935 B2 4/2011 Engelfried et al.
7,926,187 B2 4/2011 Uehlein-Proctor et al.
7,971,655 B2 7/2011 Steinke et al.
7,971,656 B2 7/2011 Engelfried et al.
7,987,921 B2 8/2011 Hahn
8,016,047 B2 9/2011 Ookubo et al.
8,051,922 B2 11/2011 Ohlendorf et al.
8,061,438 B2 11/2011 Schmid et al.
8,069,930 B2 12/2011 Engelfried
8,082,634 B2 12/2011 Frank et al.
8,087,472 B2 1/2012 Usselman et al.
8,091,651 B2 1/2012 Kuhnle et al.
8,127,862 B2 3/2012 Aoki
8,162,075 B2 4/2012 Roberts et al.
8,210,276 B2 7/2012 Krondorfer et al.
8,225,514 B2 7/2012 Guip et al.
8,234,756 B2 8/2012 Hahn et al.
8,235,138 B2 8/2012 Aoki
8,240,055 B2 8/2012 Gooding
8,240,395 B2 8/2012 Kamegai et al.
8,281,874 B2 10/2012 Imada et al.
8,286,724 B2 10/2012 Furusawa et al.
8,316,957 B2 11/2012 Kuhnle et al.
8,327,949 B2 12/2012 Meixner
9,308,636 B2 * 4/2016 Wyler ..... B25D 17/24
2003/0006051 A1 1/2003 Schmitzer et al.
2004/0040729 A1 * 3/2004 Meixner ..... B25D 17/043 173/162.2
2004/0158996 A1 * 8/2004 McIntosh ..... B23D 53/12 30/380
2005/0000097 A2 1/2005 Bednar et al.
2005/0058890 A1 3/2005 Brazell et al.
2005/0188550 A1 9/2005 Uehlein-Proctor et al.
2005/0223569 A1 10/2005 James et al.
2006/0011365 A1 * 1/2006 Stirm ..... B25D 17/043 173/162.2
2007/0034397 A1 2/2007 Fischer et al.
2007/0107920 A1 5/2007 Keller
2007/0224492 A1 9/2007 Scott et al.
2008/0022817 A1 * 1/2008 Fischer ..... B25D 17/043 81/489
2008/0099222 A1 5/2008 Ranger et al.
2008/0190631 A1 8/2008 Lemmel et al.
2008/0226971 A1 9/2008 Stickel
2009/0049651 A1 2/2009 Roberts et al.
2009/0188692 A1 7/2009 Hahn et al.
2009/0272553 A1 * 11/2009 Engelfried ..... B25D 17/043 173/162.2
2009/0283282 A1 11/2009 Zimmermann
2009/0321101 A1 12/2009 Furusawa et al.
2010/0012339 A1 1/2010 Hahn et al.
2010/0018734 A1 1/2010 Frauhammer et al.
2010/0307783 A1 12/2010 Baumann et al.
2011/0005790 A1 1/2011 Frank et al.
2011/0024149 A1 2/2011 Hecht et al.
2011/0088922 A1 * 4/2011 Hirayama ..... B25F 5/02 173/90
2011/0119934 A1 5/2011 Bertsch et al.
2011/0127056 A1 6/2011 Friedrich et al.
2011/0139477 A1 6/2011 Kuhnle et al.
2011/0162860 A1 7/2011 Gut et al.
2011/0180286 A1 * 7/2011 Oomori ..... B25F 5/008 173/20
2011/0308831 A1 12/2011 Martinsson et al.
2012/0012353 A1 1/2012 Foerster et al.
2012/0048580 A1 3/2012 Appel et al.
2012/0055689 A1 3/2012 Wierer et al.
2012/0211250 A1 8/2012 Yamauchi
2012/0279740 A1 11/2012 Furusawa et al.
2012/0298392 A1 11/2012 Weiss
2012/0305278 A1 12/2012 Esenwin
2012/0312571 A1 12/2012 Nemetz et al.
2012/0312572 A1 12/2012 Nemetz et al.
2012/0324743 A1 12/2012 Bergquist et al.
2013/0043052 A1 2/2013 Harcar et al.

(56) References Cited

U.S. PATENT DOCUMENTS

| | | | |
|---|---|---|---|
| 2013/0098647 | A1 | 4/2013 | Martinsson et al. |
| 2013/0098648 | A1 | 4/2013 | Furusawa et al. |
| 2013/0112450 | A1 | 5/2013 | Williamson et al. |

* cited by examiner

ROTARY HAMMER

CROSS-REFERENCE TO RELATED APPLICATIONS

This application is a continuation-in-part of co-pending U.S. patent application Ser. No. 13/757,090 filed on Feb. 1, 2013, now U.S. Pat. No. 9,308,636, which claims priority to U.S. Provisional Patent Application No. 61/594,675 filed on Feb. 3, 2012, Application No. 61/737,304 filed on Dec. 14, 2012, and Application No. 61/737,318 filed on Dec. 14, 2012, the entire contents of all of which are incorporated herein by reference.

This application further claims priority to U.S. Provisional Patent Application No. 61/846,303 filed on Jul. 15, 2013, the entire content of which is incorporated herein by reference.

FIELD OF THE INVENTION

The present invention relates to power tools, and more particularly to rotary hammers.

BACKGROUND OF THE INVENTION

Rotary hammers typically include a rotatable spindle, a reciprocating piston within the spindle, and a striker that is selectively reciprocable within the piston in response to an air pocket developed between the piston and the striker. Rotary hammers also typically include an anvil that is impacted by the striker when the striker reciprocates within the piston. The impact between the striker and the anvil is transferred to a tool bit, causing it to reciprocate for performing work on a work piece. This reciprocation may cause undesirable vibration that may be transmitted to a user of the rotary hammer.

SUMMARY OF THE INVENTION

The invention provides, in one aspect, a rotary power tool including a housing, a spindle defining a working axis, and a motor supported by the housing. The motor is operable to drive the spindle. The rotary power tool also includes a handle movably coupled to the housing and a vibration isolating assembly disposed between the housing and the handle. The vibration isolating assembly attenuates vibration transmitted from the housing to the handle. A battery pack is removably coupled directly to the handle and configured to provide power to the motor.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
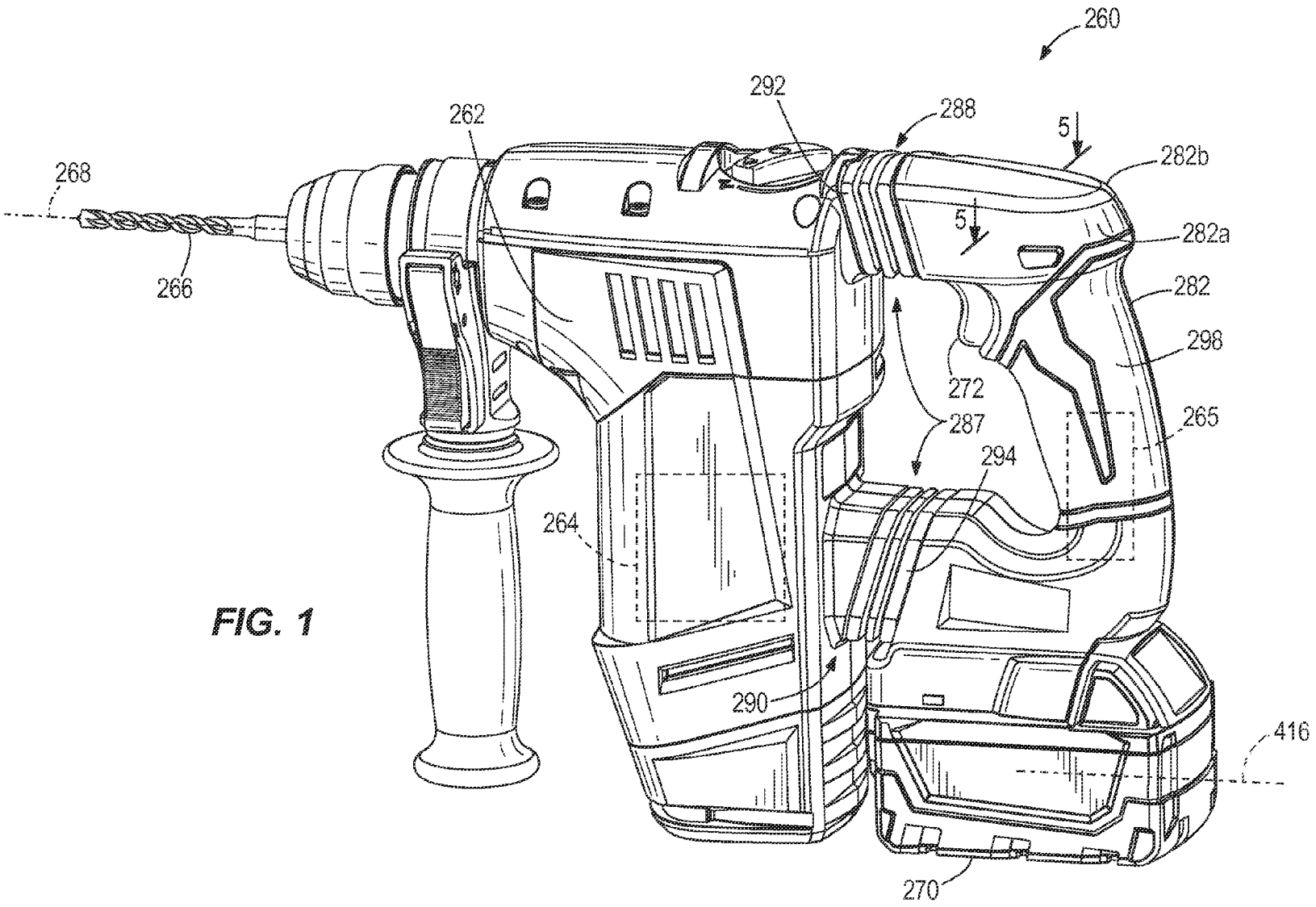
FIG. 1 is a perspective view of a rotary hammer according to an embodiment of the invention.

FIG. 1. illustrates a rotary hammer 260 according to an embodiment of the invention. The rotary hammer 260 includes a housing 262 and a motor 264 disposed within the housing 262. A tool bit 266, defining a working axis 268, is coupled to the motor 264 for receiving torque from the motor 264. The motor 264 receives power from a rechargeable battery pack 270.

In the illustrated embodiment, the motor 264 is a brushless direct-current ("BLDC") motor and includes a stator (not shown) having a plurality of coils (e.g., 6 coils) and a rotor (not shown) including a plurality of permanent magnets. Operation of the motor 264 is governed by a motor control system 265 including a printed circuit board ("PCB") (not shown) and a switching FET PCB (not shown). Alternatively, the motor 264 can be any other type of DC motor, such as a brush commutated motor.

The motor control system 265 controls the operation of the rotary hammer 260 based on sensed or stored characteristics and parameters of the rotary hammer 260. For example, the control PCB is operable to control the selective application of power to the motor 264 in response to actuation of a trigger 272. The switching FET PCB includes a series of switching FETs for controlling the application of power to the motor 264 based on electrical signals received from the control PCB. The switching FET PCB includes, for example, six switching FETs. The number of switching FETs included in the rotary hammer 260 is related to, for example, the desired commutation scheme for the motor 264. In other embodiments, additional or fewer switching FETs and stator coils can be employed (e.g., 4, 8, 12, 16, between 4 and 16, etc.).

The design and construction of the motor 264 is such that its performance characteristics maximize the output power capability of the rotary hammer 260. The motor 264 is composed primarily of steel (e.g., steel laminations), permanent magnets (e.g., sintered Neodymium Iron Boron), and copper (e.g., copper stator coils).

The illustrated BLDC motor 264 is more efficient than conventional motors (e.g., brush commutated motors) used in rotary hammers. For example, the motor 264 does not have power losses resulting from brushes. The motor 264 also combines the removal of steel from the rotor (i.e., in order to include the plurality of permanent magnets) and windings of copper in the stator coils to increase the power density of the motor 264 (i.e., removing steel from the rotor and adding more copper in the stator windings can increase the power density of the motor 264). Motor alterations such as these allow the motor 264 to produce more power than a conventional brushed motor of the same size, or, alternatively, to produce the same or more power from a motor smaller than a conventional brushed motor for use with rotary hammers.

Figure 2:
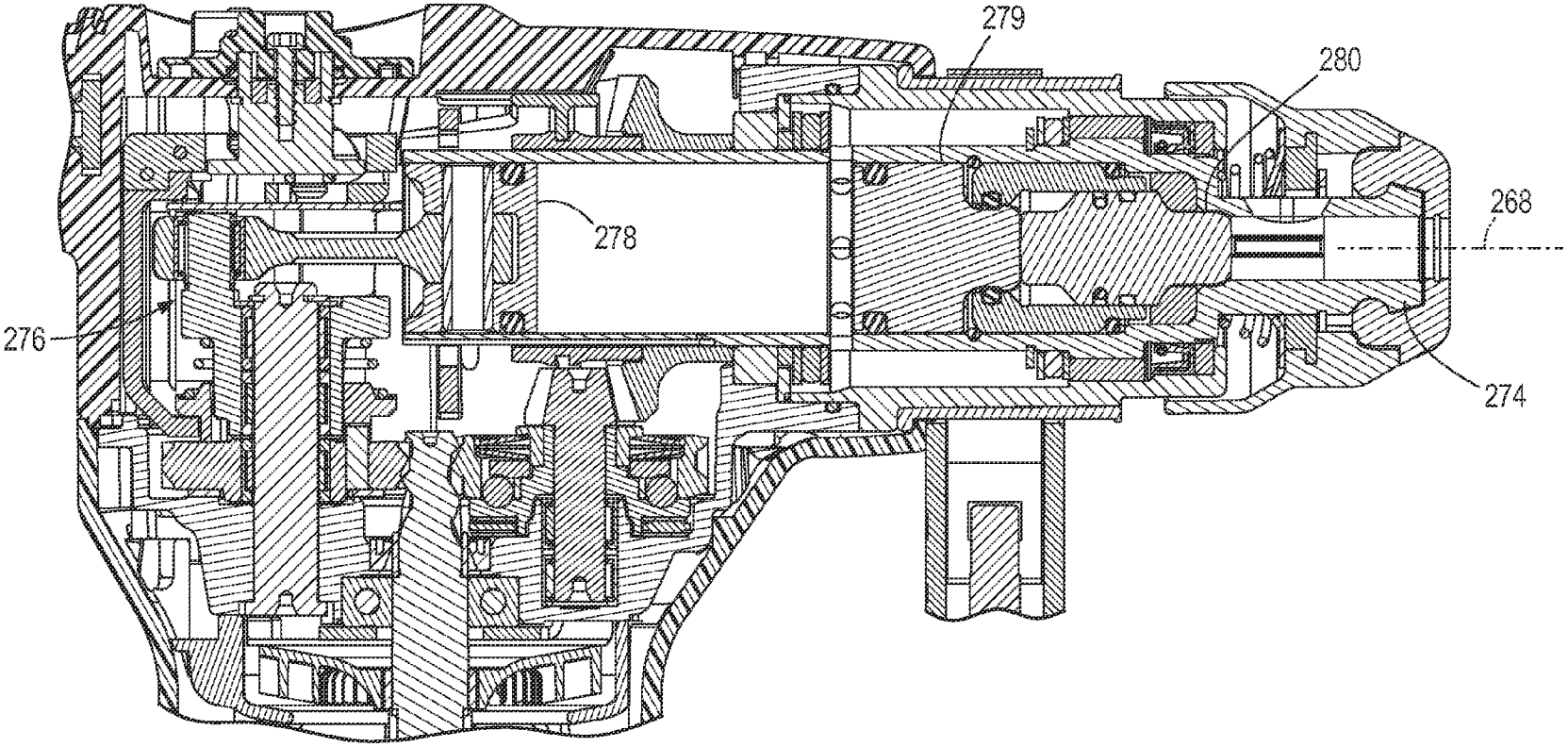
FIG. 2 is a cross-sectional view of a portion of the rotary hammer of FIG. 1.

With reference to FIG. 2, the tool bit 266 is secured to a spindle 274 for co-rotation with the spindle 274 about the working axis 268 (e.g., using a quick-release mechanism). The rotary hammer 260 further includes an impact mechanism 276 having a reciprocating piston 278 disposed within the spindle 274, a striker 279 that is selectively reciprocable within the spindle 274 in response to reciprocation of the piston 278, and an anvil 280 that is impacted by the striker 279 when the striker 279 reciprocates toward the tool bit 266. The impact between the striker 279 and the anvil 280 is transferred to the tool bit 266, causing it to reciprocate for performing work on a work piece. The spindle 274 and the impact mechanism 276 of the rotary hammer 260 can have any suitable configuration for transmitting rotary and reciprocating motion to the tool bit 266.

With reference to FIG. 1, the rotary hammer 260 further includes a handle 282 having an upper portion 284 and a lower portion 286 coupled to the housing 262 via a vibration isolating assembly 287 including an upper joint 288 and a lower joint 290. The handle 282 has an upper bellows 292 disposed between the upper portion 284 and the housing 262, and a lower bellows 294 disposed between the lower portion 286 and the housing 262. The bellows 292, 294 protect the joints 288, 290 from dust or other contamination. The handle 282 is formed from cooperating first and second handle halves 282*a*, 282*b*, and includes an overmolded grip portion 298 to provide increased operator comfort. In other embodiments, the handle 282 may be formed as a single piece or may not include the overmolded grip portion 298.

Figure 3:
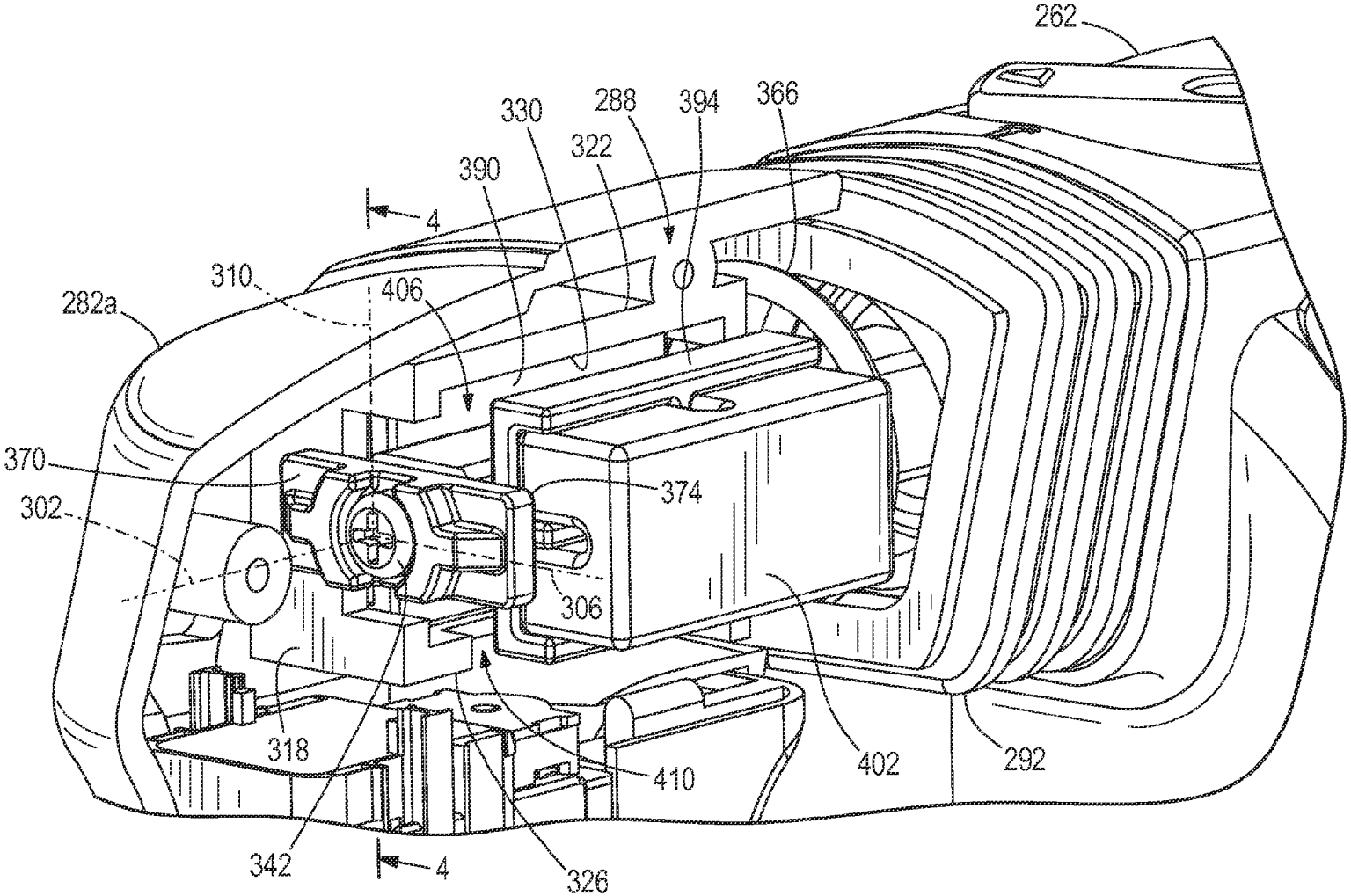
FIG. 3 is a perspective cutaway view of an upper joint of a vibration isolating assembly of the rotary hammer of FIG. 1.

Operation of the rotary hammer 260 may produce vibration at least due to the reciprocating motion of the impact mechanism 276 and intermittent contact between the tool bit 266 and a work piece. Such vibration may generally occur along a first axis 302 parallel to the working axis 268 of the tool bit (FIG. 3). Depending upon the use of the rotary hammer 260, vibration may also occur along a second axis 306 orthogonal to the first axis 302 and along a third axis 310 orthogonal to both the first axis 302 and the second axis 306. To attenuate the vibration being transferred to the handle 282, and therefore the operator of the rotary hammer 260, the upper and lower joints 288, 290 of the vibration isolating assembly 287 each permit limited movement of the handle 282 relative to the housing 262. Although a specific embodiment of the vibration isolating assembly 287 is described in detail herein, it should be understood that the vibration isolating assembly 287 can have any configuration or construction suitable for attenuating vibration transmitted from the housing 262 to the handle 282.

Figure 6:
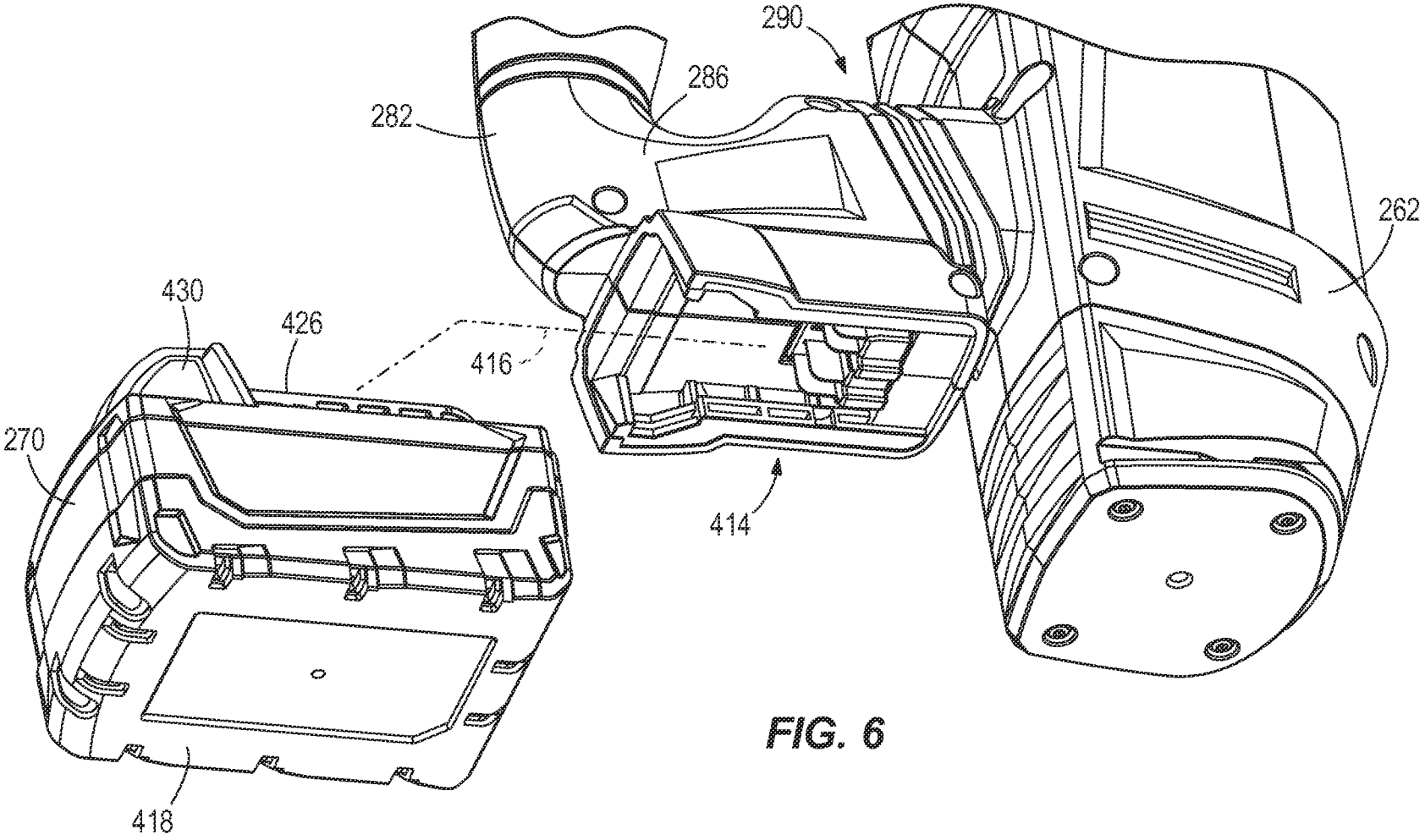
FIG. 6 is a perspective view of a battery pack removed from the rotary hammer of FIG. 1.

With reference to FIG. 6, the handle 282 includes a battery receptacle 414 adjacent the lower portion 286 of the handle 282, proximate the lower joint 290. The battery receptacle 414 defines an insertion axis 416 along which the battery pack 270 is slidable that is oriented substantially parallel to the working axis 268 of the spindle 274 (see also FIG. 1). As such, the battery pack 270 is slidable in a forward direction along the insertion axis 416 to insert the battery pack 270 into the receptacle 414 and in a rearward direction along the insertion axis 416 to remove the battery pack 270 from the receptacle 414. The battery pack 270 includes a housing 418 and a plurality of rechargeable battery cells (not shown) supported by the battery housing 418. The battery pack 270 also includes a support portion 426 for securing the battery pack 270 within the battery receptacle 414, and a locking mechanism 430 for selectively locking the battery pack 270 to the battery receptacle 414.

In the illustrated embodiment, the battery pack 270 is designed to substantially follow the contours of the rotary hammer 260 to match the general shape of the handle 282 and housing 262 of the rotary hammer 260 (FIG. 1). Because the battery pack 270 is supported on the handle 282, the vibration isolating assembly 287 also substantially isolates the battery pack 270 from the vibration produced during operation of the rotary hammer 260. The mass of the battery pack 270 adds inertia to the handle 282 which further reduces the vibration experienced by the operator of the rotary hammer 260.

The battery cells can be arranged in series, parallel, or a series-parallel combination. For example, in the illustrated embodiment, the battery pack 270 includes a total of ten battery cells configured in a series-parallel arrangement of five sets of two series-connected cells. The series-parallel combination of battery cells allows for an increased voltage and an increased capacity of the battery pack 270. In other embodiments, the battery pack 270 can include a different number of battery cells (e.g., between 3 and 12 battery cells) connected in series, parallel, or a series-parallel combination in order to produce a battery pack having a desired combination of nominal battery pack voltage and battery capacity.

The battery cells are lithium-based battery cells having a chemistry of, for example, lithium-cobalt ("Li—Co"), lithium-manganese ("Li—Mn"), or Li—Mn spinel. Alternatively, the battery cells can have any other suitable chemistry. In the illustrated embodiment, each battery cell has a nominal voltage of about 3.6V, such that the battery pack 270 has a nominal voltage of about 18V. In other embodiments, the battery cells can have different nominal voltages, such as, for example, between about 3.6V and about 4.2V, and the battery pack 270 can have a different nominal voltage, such as, for example, about 10.8V, 12V, 14.4V, 24V, 28V, 36V, between about 10.8V and about 36V, etc. The battery cells also have a capacity of, for example, between about 1.0 ampere-hours ("Ah") and about 5.0 Ah. In exemplary embodiments, the battery cells can have capacities of about, 1.5 Ah, 2.4 Ah, 3.0 Ah, 4.0 Ah, between 1.5 Ah and 5.0 Ah, etc.

The vibration isolating assembly 287 will now be described in more detail with reference to FIGS. 3-5. To attenuate the vibration being transferred to the handle 282 and the battery pack 270, and therefore the operator of the rotary hammer 260, the upper and lower joints 288, 290 of the vibration isolating assembly 287 each permit limited movement of the handle 282 relative to the housing 262 in the directions of the first axis 302, the second axis 306, and the third axis 310 (FIG. 3). For example, the upper and lower joints 288, 290 enable movement of the handle 282 relative to the housing 262 along the first axis 302 between an extended position and a retracted position. The extended position and the retracted position correspond with the respective maximum and minimum relative distances between the handle 282 and the housing 262 during normal operation of the rotary hammer 260. The upper and lower joints 288, 290 are structurally and functionally identical, and as such, only the upper joint 288 is described in greater detail herein. Like components are identified with like reference numerals.

Figure 4:
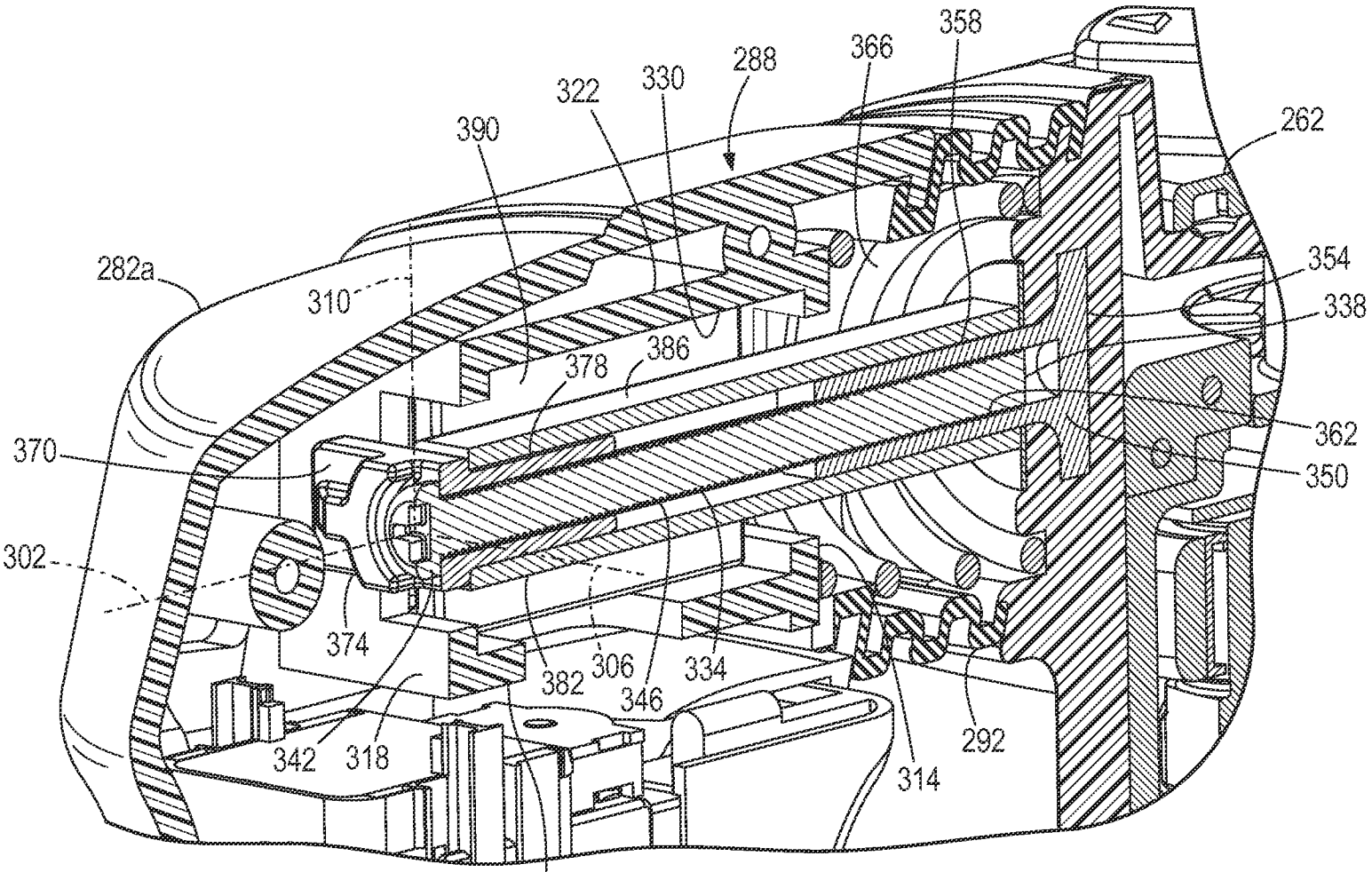
FIG. 4 is a cross-sectional view of the upper joint of FIG. 3 taken through line 4-4.

With reference to FIG. 4, the first and second handle halves 282*a*, 282*b* each include a front wall 314, a rear wall 318, an upper wall 322, and a lower wall 326 that collectively define a cavity 330 when the first and second handle halves 282*a*, 282*b* are attached. The upper joint 288 includes a rod 334 having a distal end 338 coupled to the housing 262, a head 342 opposite the distal end 338, and a shank 346 extending through the cavity 330. The distal end 338 is coupled to the housing 262 by a first, generally T-shaped bracket 350. The bracket 350 includes a rectangular head 354 and a post 358 extending from the head 354. In the illustrated embodiment, the rod 334 is a threaded fastener (e.g., a bolt), and the post 358 includes a threaded bore 362 in which the threaded end 338 of the rod 334 is received. In other embodiments, the rod 334 may be coupled to the bracket 350 in any suitable fashion (e.g., an interference fit, etc.), or the rod 334 may be integrally formed as a single piece with the bracket 350. In the illustrated embodiment, the bracket 350 is coupled to the housing 262 using an insert molding process. Alternatively, the bracket 350 may be coupled to the housing 262 by any suitable method.

With continued reference to FIG. 4, the upper joint 288 includes a biasing member 366 disposed between the upper portion 284 of the handle 282 and the housing 262. The biasing member 366 is deformable to attenuate vibration transmitted from the housing 262 along the first axis 302. In the illustrated embodiment, the biasing member 366 is a coil spring; however, the biasing member 366 may be configured as another type of elastic structure. The upper joint 288 also includes a second, generally T-shaped bracket 370 coupled to the rod 334. The bracket 370 includes a rectangular head 374 and a hollow post 378 extending from the head 374 through which the shank 346 of the rod 334 extends. The head 342 of the rod 334 limits the extent to which the shank 346 may be inserted within the hollow post 378. A sleeve 382, having a generally square cross-sectional shape, surrounds the rod 334 and the posts 358, 378 of the brackets 350, 370 to provide smooth, sliding surfaces 386 (FIG. 5) along the length of the rod 334. The rectangular head 374 of the bracket 370 is configured to abut the rear walls 318 of the respective handle halves 282*a*, 282*b* in the extended position of the handle 282 and to be spaced from the rear walls 318 of the respective handle halves 282*a*, 282*b* as the handle 282 moves towards the retracted position.

Figure 5:
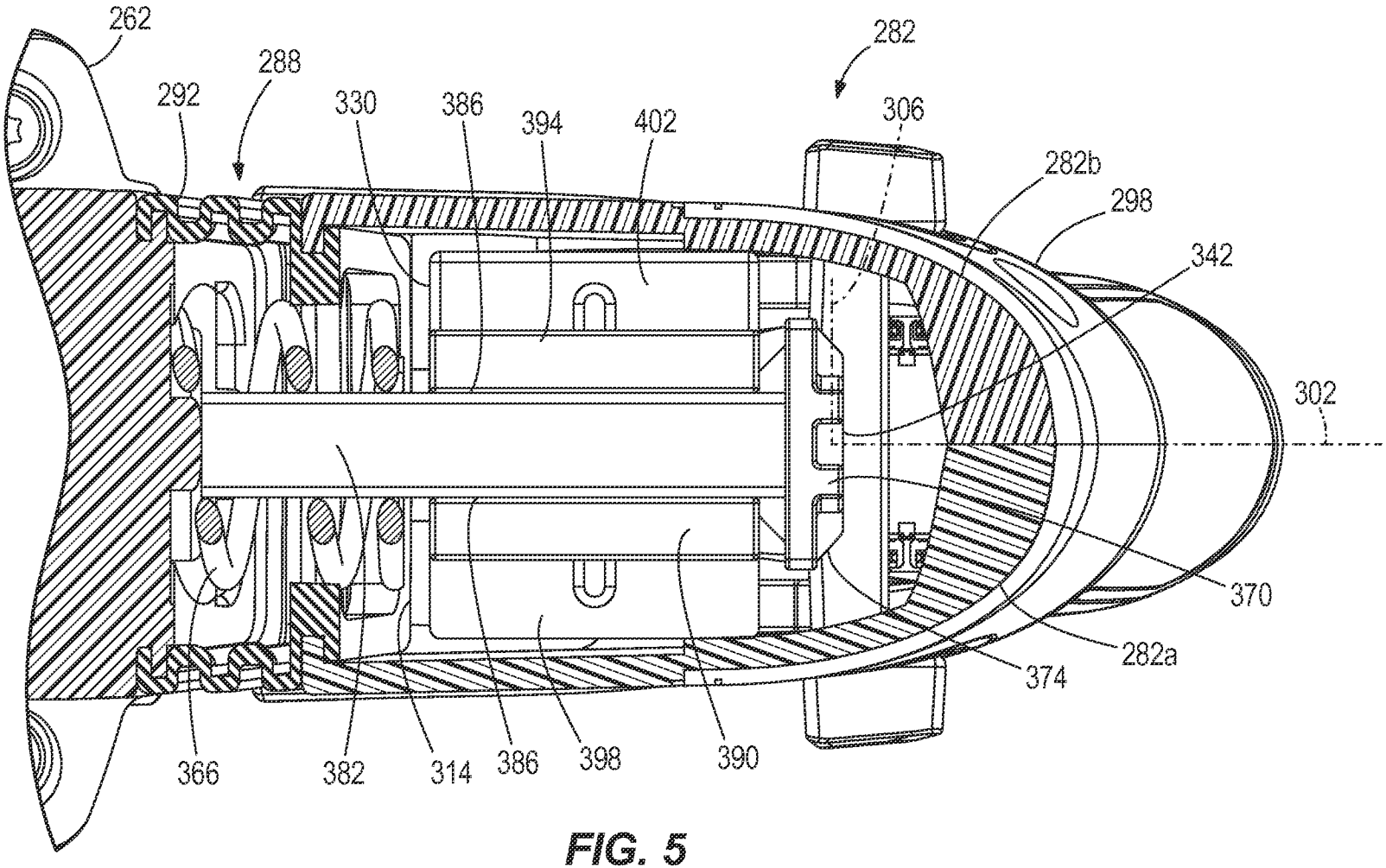
FIG. 5 is a cross-sectional view of the upper joint of FIG. 3 taken through line 5-5 in FIG. 1.

With continued reference to FIG. 5, the upper joint 288 also includes a first guide 390 and a second guide 394 positioned within the cavity 330 on opposing sides of the sleeve 382. The guides 390, 394 are constrained within the cavity 330 along the first axis 302 by the front and rear walls 314, 318 of the handle halves 282*a*, 282*b* such that the guides 390, 394 move with the handle 282 along the sliding surfaces 386 of the sleeve 382 as the handle 282 moves along the first axis 302. A first bumper 398 is disposed within the cavity 330 between the first guide 390 and the first handle half 282*a*, and a second bumper 402 is disposed within the cavity 330 between the second guide 394 and the second handle half 282*b*. The bumpers 398, 402 are formed from an elastic material (e.g., rubber) and are deformable to allow the handle 282 to move relative to the housing 262 a limited extent along the second axis 306 (see also FIG. 4). The bumpers 398, 402 resist this movement, thereby attenuating vibration transmitted from the housing 262 to the handle 282 along the second axis 306.

With reference to FIG. 3, the upper joint 288 includes a gap 406 between the sleeve 382 and the upper walls 322 of the handle halves 282*a*, 282*b*, and another gap 410 between the sleeve 382 and the lower walls 326 of the handle halves 282*a*, 282*b*. The gaps 406, 410 allow the guides 390, 394 to slide relative to the sleeve 382 a limited extent along the third axis 310. The gaps 406, 410 therefore allow the handle 282 to move relative to the housing 262 a limited extent along the third axis 310. The biasing member 366 resists shearing forces developed by movement of the handle 282 along the third axis 310, thereby attenuating vibration transmitted to the handle 282 along the third axis 310. In addition, the upper bellows 292 is formed from a resilient material and further resists the shearing forces developed by movement of the handle 282 along the third axis 310, thereby providing additional vibration attenuation. Similarly, the lower bellows 294 attenuates vibration transmitted to the handle 282 along the third axis 310 in conjunction with the lower joint 290.

In operation of the rotary hammer 260, vibration may occur along the first axis 302, the second axis 306, and/or the third axis 310 depending on the use of the rotary hammer 260. When the handle 282 (and therefore, the battery pack 270) moves relative to the housing 262 along the first axis 302 between the extended position and the retracted position of the handle 282, the biasing member 366 of each of the joints 288, 290 expands and compresses accordingly to attenuate the vibration occurring along the first axis 302. Additionally, the bumpers 398, 402 of each of the joints 288, 290 elastically deform between the handle halves 282*a*, 282*b* and the guides 390, 394, respectively, to permit limited movement of the handle 282 and the battery pack 270 relative to the housing 262 along the second axis 306, thereby attenuating vibration occurring along the second axis 306. Finally, the gaps 406, 410 defined by each of the joints 288, 290 allow for limited movement of the handle 282 and the battery pack 270 relative to the housing 262 along the third axis 310, and the biasing member 366 and the upper and lower bellows 292, 294 resist the resulting shearing forces to attenuate the vibration occurring along the third axis 310.

Thus, the invention provides a battery-powered rotary hammer having a housing, a handle, a vibration isolating assembly between the housing and the handle for attenuating vibration transmitted from the housing to the handle, and a battery pack removably coupled to the handle such that the battery pack is also at least partially isolated from the vibration.

Various features of the invention are set forth in the following claims.

What is claimed is:

1. A rotary power tool comprising:

a housing;

a spindle defining a working axis;

a motor supported by the housing and operable to drive the spindle;

a handle movably coupled to the housing;

a vibration isolating assembly disposed between the housing and the handle for attenuating vibration transmitted from the housing to the handle; and a battery pack removably coupled directly to the handle and configured to provide power to the motor;

wherein the handle includes an upper portion and a lower portion, and wherein the vibration isolating assembly includes an upper joint coupling the upper portion of the handle to the housing and a lower joint coupling the lower portion of the handle to the housing;

wherein each of the upper and lower joints includes a rod extending into the handle and a biasing member disposed between the handle and the housing, the biasing member operable to bias the handle toward an extended position;

wherein each of the upper and lower joints further includes a first bracket fixed to one of the housing and the rod and a second bracket coupled to the other of the housing and the rod, wherein at least one of the first bracket and the second bracket limits movement of the handle to the extended position;

wherein each of the upper and lower joints further includes a guide disposed within the handle, the guide being slidable along the rod as the handle moves between the extended position and the retracted position;

wherein each of the upper and lower joints further includes a bumper disposed between the guide and the handle, the bumper operable to attenuate vibration transmitted along a second axis orthogonal to the working axis.

2. The rotary power tool of claim 1, further comprising:

a battery receptacle located on the handle, the battery receptacle configured to receive the battery pack when the battery pack is coupled to the handle, and wherein the battery receptacle defines an insertion axis along which the battery pack is slidable that is oriented substantially parallel to the working axis of the spindle.

3. The rotary power tool of claim 2, wherein the battery receptacle is located on the handle adjacent the lower portion.

4. The rotary power tool of claim 1, further comprising an upper bellows surrounding at least a portion of the upper joint and a lower bellows surrounding at least a portion of the lower joint.

5. The rotary power tool of claim 1, wherein at least one of the upper joint and the lower joint is operable to attenuate vibration transmitted along a first axis parallel to the working axis.

6. The rotary power tool of claim 5, wherein both the upper joint and the lower joint are operable to attenuate vibration transmitted along a first axis parallel to the working axis.

7. The rotary power tool of claim 5, wherein at least one of the upper joint and the lower joint is operable to attenuate vibration transmitted along a third axis orthogonal to the first axis and the second axis.

8. The rotary power tool of claim 7, wherein both the upper joint and the lower joint are operable to attenuate vibration transmitted along the third axis.

9. The rotary power tool of claim 1, further comprising a tool bit coupled to the spindle; and an impact mechanism operable to deliver axial impacts to the tool bit.

10. The rotary power tool of claim 9, wherein the impact mechanism includes a reciprocating piston disposed within the spindle;

a striker selectively reciprocable within the spindle in response to reciprocation of the piston; and an anvil that is impacted by the striker when the striker reciprocates toward the tool bit, the anvil configured to transfer the impact to the tool bit.

11. The rotary power tool of claim 1, wherein the motor is a brushless direct-current motor.

12. The rotary power tool of claim 1, wherein the vibration isolating assembly substantially isolates the battery pack from vibration produced during operation of the rotary power tool.

13. The rotary power tool of claim 1, wherein the battery pack is a rechargeable lithium-ion battery pack.

* * * * *